US007641441B2

(12) United States Patent
Chuang

(10) Patent No.: US 7,641,441 B2
(45) Date of Patent: Jan. 5, 2010

(54) FAN DEVICE

(75) Inventor: Chih-Peng Chuang, Taipei (TW)

(73) Assignee: Inventec Corporation, Taipei (TW)

( * ) Notice: Subject to any disclaimer, the term of this patent is extended or adjusted under 35 U.S.C. 154(b) by 455 days.

(21) Appl. No.: 11/525,323

(22) Filed: Sep. 22, 2006

(65) Prior Publication Data

US 2008/0075579 A1 Mar. 27, 2008

(51) Int. Cl.
*F01B 25/26* (2006.01)

(52) U.S. Cl. ..... 415/118; 415/214.1; 417/423.14

(58) Field of Classification Search ..... 415/118, 415/214.1, 220; 361/695; 417/423.14; 362/96, 362/555

See application file for complete search history.

(56) References Cited

U.S. PATENT DOCUMENTS 4,479,115 A * 10/1984 Holzhauer ..... 340/611
6,554,443 B2 * 4/2003 Fan ..... 362/96
6,588,913 B1 * 7/2003 Huang ..... 362/96
6,790,003 B1 * 9/2004 Hu et al. ..... 416/5
6,969,180 B2 * 11/2005 Waters ..... 362/293
7,037,073 B2 * 5/2006 Lin ..... 416/5
7,048,498 B2 * 5/2006 Kosugi ..... 415/118
7,055,977 B2 * 6/2006 Lai ..... 362/96
7,121,697 B2 * 10/2006 Hsu ..... 362/386

* cited by examiner

*Primary Examiner*—Edward Look
*Assistant Examiner*—Sean J Younger
(74) *Attorney, Agent, or Firm*—Peter F. Corless; Steven M. Jensen; Edwards Angell Palmer & Dodge LLP

(57) ABSTRACT

A fan device for use in an electronic apparatus is proposed, the fan device being installed adjacent to a back-panel formed with an emitting diode component and composed of: a fan body, a fastening member and a light-guiding member, wherein the fan body is provided with a plurality of positioning holes for accommodating the light-guiding member, which is then fastened by the fastening member such that the end of the light-guiding member is close to the back panel to provide for a light source by means of the emitting diode of the back panel, allowing the light-guiding member to receive and guide the light to the front of the fan body, whereby the use can observe and judge if the fan device works normally or not from the varied brightness of light shown by the light-guiding member.

6 Claims, 2 Drawing Sheets

FAN DEVICE

FIELD OF THE INVENTION

The present invention relates to fan devices, and more particularly, to a fan device having a light-guiding member.

BACKGROUND OF THE INVENTION

Behind the high-speed operation, electronic component often create a massive quantity of heat, for example The central processor along with the operating speed promotion, the relative operating time also must continuously increase, however produces quantity of heat also along with it increase, force the temperature raise, create the electronic products interior high temperature unable to dissipate. However, high temperature can cause the characteristic changes, then electronic component life to be shortened. According to present technology, majorities are using the heat-dissipating fan to discharge the electronic products interior quantity of heat. Therefore, to decide the function of the fan device works or not becomes an important issue.

In prior art, the light signal circuit is placed on the surface of the electronic products, makes the light signal separately to represent the working situation of the fan device. Suppose the light signal circuit has four light signals to correspond the work status with other four fan devices, signal is on represent the device failure, on the other hand, light is off stands for normal condition. Whereby the user can observe and decide whether the fan device works normally or not. However, the separation has caused the vision difference between the fan device and the signal of the light signal circuit. Then result of the countermeasure was a mistake.

Therefore, to provide one kind of fan device to avoid any further vision difference and wrong countermeasure would be the most important task to resolve.

SUMMARY OF THE INVENTION

In light of the above prior-art drawbacks, a primary objective for the present invention is to provide a fan device to avoid any further vision difference and wrong countermeasure.

Another objective of this present invention is to provide a fan device with simple structure, easy to install and do not occupy the space.

As aforementioned purpose, this fan device is assembling with a fan body, a fastening member and a light-guiding member; and the light-guiding member is fastening by the fan body. Whereby the user can observe and judge if the fan device works normally or not from the varied brightness of light shown by the light-guiding member.

The fan device for use in an electronic apparatus is proposed, the fan device being installed adjacent to a back-panel formed with an emitting diode component. The fan device is formed with plurality of positioning holes; the fastening member included a first coupling portion, a fixing portion and a securing portion, which coordinates with a signal connector to provide the power and connect the control signal.

This light-guiding member is installed in the plurality positioning holes of the fan body and this is also including a second coupling portion, a light-guiding portion and an end portion of the light-guiding portion. According to the mutually coupling with the first and second coupling portion of the fastening member, allowing the light-guiding member is close to the back panel to provide a light source by means of the emitting diode component of the back panel to receive and guide the light to the light-guiding portion.

This present invention of the fan device is accommodating the light-guiding member in the plurality positioning holes of fan body, According to the mutually coupling with the first and second coupling portion of the fastening member, allowing the light-guiding member is close to the back panel to provide a light source by means of the emitting diode component of the back panel to receive and guide the light to the light-guiding portion; and the user can observe and judge whether the fan device works normally or not from the varied brightness of light shown by the light-guiding member. Aiming at solving the emitting diode component on the fan of the prior art and make it is easy to disassemble and do not occupy the space.

DETAILED DESCRIPTION OF THE DRAWINGS

The present invention can be more fully understood by reading the following detailed description of the preferred embodiments, with reference made to the accompanying drawing.

FIG. 1 is a perspective view of a fan device of the present invention. As shown in FIG. 1, the fan device comprises a fan body 2, a light-guiding member 1 for guiding light emitted by a light emitting diode (LED) to a region in front of the fan body 2, and a fastening member 3 for fastening the light-guiding member 1 to the fan body 2. Therefore, a user is allowed to observe and judge whether the fan device works properly or not in view of the varied brightness of light emitted by the light-guiding member 1. The fan device is installed in an electronic apparatus, and adjacent to a back-panel having the LED.

A plurality of positioning holes 21 are installed on the fan body 2 for receiving the light-guiding member 1.

The fastening member 3 comprises a first coupling portion 31 connectable to a signal connector 4 for providing power and connection control signals. The first coupling portion 31 is a coupling cavity. The fastening member 3 further comprises a fixing portion 32 and a securing portion 33. The fixing portion 32 fixes the fastening member 3 to the fan body 2. The securing portion 33 is use for securing the signal connector 4, such that the signal connector 4 is electrically connected to the fan body 2 and provides the power and connection control signals to the fan body 2.

The light-guiding member 1 comprises a second coupling portion 11, a light-guiding portion 12 and an end portion 13. The light-guiding member 1 is received in the positioning holes 21 of the fan body 2 and fixed to the fan body 2 by coupling the first coupling portion 31 to the second coupling portion 11 with the fastening member 3. Therefore, the end portion 13 of the light-guiding member 1 is close to the back panel, and the light-guiding member 1 receives the light emitted by the LED installed on the back panel and guides the light onto the light-guiding portion 12. The light-guiding member 1 is in the shape of a pipe or a stick, and comprises acrylic, plastic, glass or metal. The second coupling portion 11 is a ring groove.

FIG. 2 is an assembly perspective view of the fan device. The light-guiding member 1 is received in the positioning holes 21 of the fan body 2, and fixed to the fan body 2 by the coupling of the first coupling portion 31 of the fastening member 3 and the second coupling portion 11 of the light-guiding member 1. The signal connector 4 is fixed by the fixing portion 33 of the fastening member 3 and electrically connected to the fan body 2 and provides the power and connection control signals to the fan body 2. When the light-guiding member 1 is fixed by the fastening member 3, the end portion 13 of the light-guiding member 1 is close to the back panel, so that the light-guiding member 1 receives the light emitted by the LED installed on the back panel and guides the light to the light-guiding portion 12. Therefore, a user is allowed to observe and judge whether the fan device works normally or not in view of the varied brightness of light shown on the light-guiding member 1. Aiming at solving the emitting diode component on the fan of the prior art and make it is easy to disassemble and do not occupy the space.

As mentioned above, this invention of the fan device is provided with a plurality of positioning holes for accommodating the light-guiding member, then fastened by the fastening member such that the end of the light-guiding member is close to the back panel to provide for alight source by means of the emitting diode of the back panel, allowing the light-guiding member to receive and guide the light to the front of the fan body by means of the light signal display to couple with fan device to avoid the visual mistaking and cause the wrong judgment and the normalization of the fan device.

The invention has been described using exemplary preferred embodiments. However, it is to be understood that the scope of the invention is not limited to the disclosed embodiments. On the contrary, it is intended to cover various modifications and similar arrangement. The scope of the claims therefore should be accorded the broadest interpretation so as to encompass all such modifications as similar arrangements.

Figure 1:
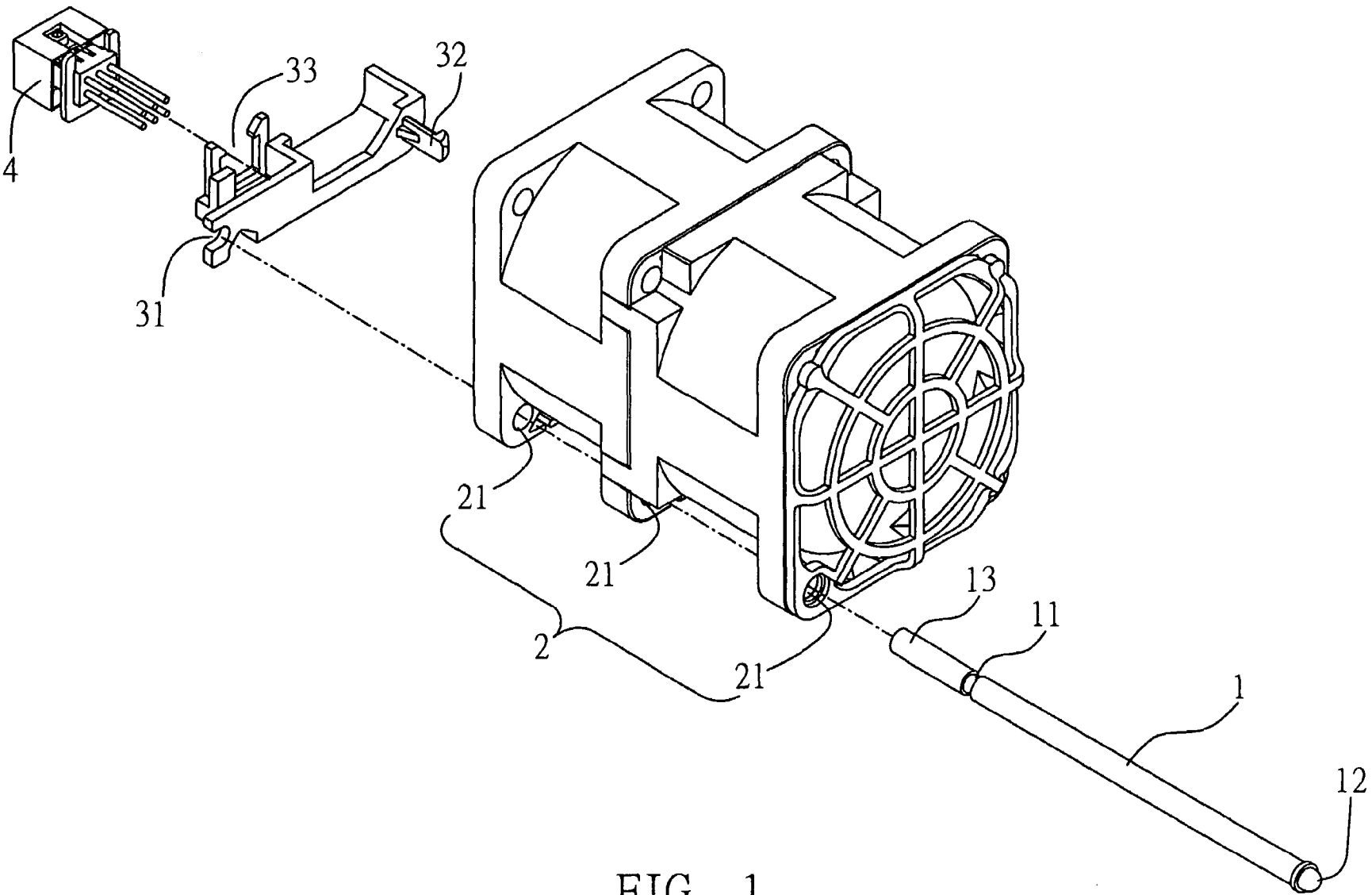
FIG. 1 is a perspective view of a fan device of the present invention.
Figure 2:
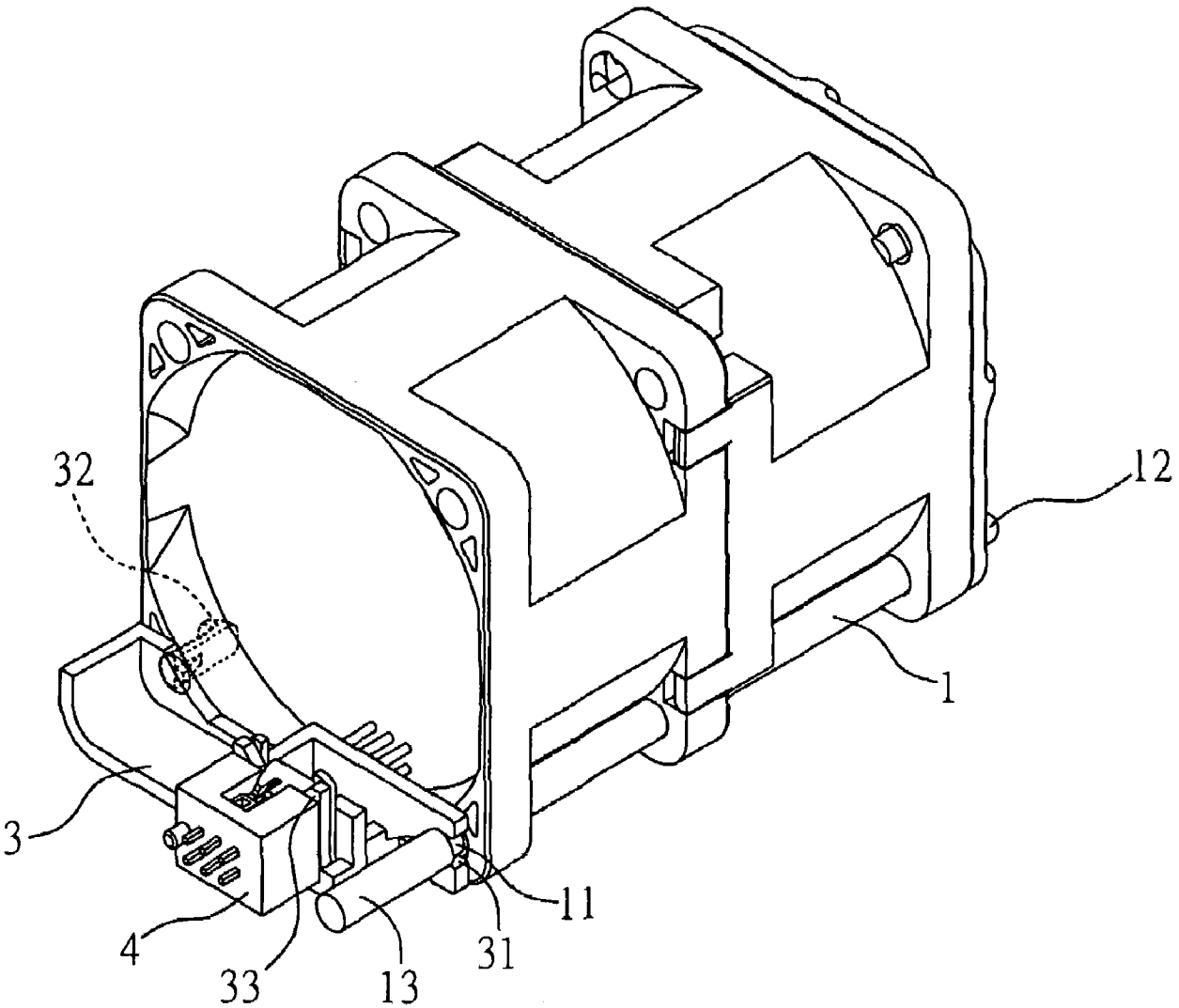
FIG. 2 is an assembly perspective view of the fan device shown in FIG. 1.

What is claimed is:

1. A fan device for use in an electronic apparatus, the fan device being installed adjacent to a back-panel having a light emitting diode (LED) for emitting light, the fan device comprising:

a fan body having a plurality of positioning holes;

a fastening member having a first coupling portion; and a light-guiding member received in one of the positioning holes of the fan body, the light-guiding member comprising a ring groove, an end portion, and a light-guiding portion, the ring groove being used for coupling to the first coupling portion, so as to fix the light-guiding member to the fan body and place the end portion to be close to the back panel, so that the light-guiding member receives the light and guides the light to the light-guiding portion.

2. The fan device of claim 1, wherein the fastening member is connectable to a signal connector for providing power and connection control signals.

3. The fan device of claim 2, wherein the fastening member further comprises a fixing portion for fixing the signal connector.

4. The fan device of claim 1, wherein the first coupling portion is a coupling cavity.

5. The fan device of claim 1, wherein the light-guiding member is in the shape of one selected from the group consisting of a pipe and a stick.

6. The fan device of claim 1, wherein the light-guiding member comprises one selected from the group consisting of acrylic, plastic, glass and metal.

* * * * *